US009845567B2

(12) United States Patent
Contarini et al.

(10) Patent No.: US 9,845,567 B2
(45) Date of Patent: Dec. 19, 2017

(54) LAUNDRY DRYING MACHINE

(71) Applicant: Electrolux Appliances Aktiebolag, Stockholm (SE)

(72) Inventors: Andrea Contarini, Sacile (IT); Massimo Viero, Pianezze (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 15/125,739

(22) PCT Filed: Mar. 5, 2015

(86) PCT No.: PCT/EP2015/054608

§ 371 (c)(1),
(2) Date: Sep. 13, 2016

(87) PCT Pub. No.: WO2015/139966

PCT Pub. Date: Sep. 24, 2015

(65) Prior Publication Data

US 2017/0002506 A1 Jan. 5, 2017

(30) Foreign Application Priority Data

Mar. 21, 2014 (EP) ..... 14161141

(51) Int. Cl.
*D06F 58/24* (2006.01)
*D06F 39/12* (2006.01)
(Continued)

(52) U.S. Cl.
CPC ..... *D06F 58/24* (2013.01); *D06F 39/12* (2013.01); *D06F 58/02* (2013.01); *D06F 58/20* (2013.01)

(58) Field of Classification Search
CPC ..... D06F 58/24; D06F 58/02; D06F 58/20; D06F 39/12
(Continued)

(56) References Cited

U.S. PATENT DOCUMENTS 3,805,404 A * 4/1974 Gould ..... D06F 58/04 34/596
4,519,145 A * 5/1985 Mandel ..... D06F 5/203 243/389
(Continued)

FOREIGN PATENT DOCUMENTS

EP 2270274 A1 1/2011
EP 2385163 A1 11/2011
IT EP 1740831 A1 * 1/2007 ..... F04B 35/045

OTHER PUBLICATIONS

International Search Report issued in corresponding International Application No. PCT/EP2015/054608, dated Apr. 20, 2015.

*Primary Examiner* — Stephen M Gravini
(74) *Attorney, Agent, or Firm* — Banner & Witcoff, Ltd.

(57) ABSTRACT

A laundry machine (100) adapted to dry laundry by means of a flow of drying air has a machine cabinet (110) for accommodating components necessary for the operation of the laundry machine (100). Inside the cabinet is a laundry treatment chamber (105) adapted to contain the laundry to be dried. A cabinet top element (125) incorporated at least part of a drying air circuit in fluid communication with the laundry treating chamber through a drying air inlet opening (210) and through a drying air outlet opening (215) formed in the cabinet top element The cabinet top element has a bottom base element (205) and a top cover (240) and, defined in an interspace between the base element and the top cover, a drying air path for the flow of drying air between said drying air inlet opening (210) and said drying air outlet opening (215). The drying air path includes a moisture condensing arrangement (225, 230). The drying air inlet opening (210) is formed in a wall (217*a*) extending within the interspace between the base element (205) of the top element (125) and the top cover (240) thereof.

17 Claims, 6 Drawing Sheets

(51) Int. Cl.
*D06F 58/02* (2006.01)
*D06F 58/20* (2006.01)

(58) Field of Classification Search
USPC ..... 34/73, 595; 68/19, 20
See application file for complete search history.

(56) References Cited

U.S. PATENT DOCUMENTS

| | | | | | |
|---|---|---|---|---|---|
| 5,367,787 | A * | 11/1994 | Ikeda | D06F 43/086 | 34/477 |
| 7,347,009 | B2 * | 3/2008 | Ahn | D06F 58/24 | 34/607 |
| 8,490,438 | B2 * | 7/2013 | Kim | D06F 25/00 | 34/596 |
| 8,919,009 | B2 * | 12/2014 | Colombo | D06F 58/203 | 34/413 |
| 9,207,015 | B2 * | 12/2015 | Ahn | D06F 58/02 | |
| 9,228,293 | B2 * | 1/2016 | Yeom | D06F 58/04 | |
| 9,273,903 | B2 * | 3/2016 | Vian | D06F 58/24 | |
| 9,297,493 | B2 * | 3/2016 | Bison | D06F 58/06 | |
| 9,335,095 | B2 * | 5/2016 | Bison | D06F 39/12 | |
| 9,359,714 | B2 * | 6/2016 | Contarini | D06F 58/203 | |
| 9,372,031 | B2 * | 6/2016 | Contarini | D06F 58/206 | |
| 9,435,069 | B2 * | 9/2016 | Contarini | D06F 58/206 | |
| 9,534,329 | B2 * | 1/2017 | Contarini | D06F 39/02 | |
| 2017/0002506 | A1 * | 1/2017 | Contarini | D06F 58/24 | |

* cited by examiner

LAUNDRY DRYING MACHINE

CROSS REFERENCE TO RELATED APPLICATIONS

This application is a national stage application filed under 35 U.S.C. 371 of International Application No. PCT/EP2015/054608, filed Mar. 21, 2014, which claims priority from European Patent Application No. 14161141.8, filed Mar. 21, 2014, each of which is incorporated by reference herein in its entirety.

BACKGROUND OF THE INVENTION

Field of the Invention

The present invention relates to laundry treatment appliances or machines. In more detail, the present invention refers to appliances for drying laundry (laundry drying machines), both for domestic and professional use, and particularly to a laundry washing machine also having a laundry drying functionality (laundry washing/drying machines).

Background

Laundry drying and laundry washing/drying machines—which will be referred to simply as laundry machines in the following—typically comprise a casing substantially parallelepiped—shaped forming a machine cabinet. The cabinet accommodates therein a laundry treating chamber, comprising a drum, generally rotatable, apt to contain the laundry to be dried. In laundry washing/drying machines, the drum is rotatably contained in a washing tub, adapted to contain the laundry washing liquid when the machine is operated in laundry washing mode. A front panel of the cabinet has a loading opening to access the treating chamber, for loading/unloading the laundry, and a door is hinged to the cabinet front panel for closing the loading opening, particularly during the laundry machine operation.

The cabinet also accommodates the electrical, electronic, electro-mechanical, mechanical, and hydraulic components necessary for the operation of the laundry machine. Particularly, laundry machines features an air circuit (comprising, for example, fans, air ducts, a moisture condensing unit, a heating unit, etc.) adapted to heat air, blow it into the drum where it removes moisture from the laundry, suck out from the drum the moisturized air, de-moisturize the air and reiterate such actions thereby performing a laundry drying cycle.

In a known type of laundry machines, also referred to as "condenser dryer", the drying air flow is typically caused to pass through the drum, exiting therefrom from the drum front access opening, then the moisture-laden drying air flow passes through a moisture condensing system, where the humid air is at least partially dehydrated, dried, and the dried drying air flow is heated up by means of a heating arrangement, like an electrical resistance; the heated drying air flow then passes again through the drum, and repeats the cycle.

The condensing system may be an air-air heat exchanger, exploiting air taken in from the outside.

Other known laundry machines exploit a heat pump to dehydrate the drying air flow. In these laundry machines, the function of the heating arrangement may be performed by the heat pump itself, and the electrical resistance may thus not be provided for.

For some household appliance manufacturers, it might be interesting to exploit the already existing design of a laundry washing machine for producing and offering to the customers a laundry washer/dryer. The addition of those components and parts, that are necessary for the laundry drying function, should have as low as possible impact on the already existing design; in particular, the additional components should be housed within the already existing laundry washing machine cabinet.

EP 2270274 discloses a top adapted to match and close from above a cabinet of a laundry drying appliance, the top being formed as a ready-to-mount part ready to be mounted to the cabinet and forming a moisture condensing module for dehydrating drying air used to dry laundry within a drying drum of the laundry drying appliance. The top has a drying air inlet, a drying air outlet, fluid passageways defined thereinside from said drying air inlet to said drying air outlet for the passage of the drying air to be dehydrated and moisture condensing means arranged inside said fluid passageways.

The top disclosed in EP 2270274, once assembled, forms a unit that is ready to be mounted to the machine cabinet, simply by placing the top in the correct alignment, so that the drying air inlet opening and the drying air outlet opening match an outlet of a drying air return duct and, respectively, an intake of a drying air circulation fan, both of which are fixed, rigidly connected to the machine cabinet. In such a way, the outlet of the return air duct and the air intake of the air circulation fan act as automatic positioning and centering means for the top, simplifying the mounting thereof: the operation of mounting of the top onto the cabinet simply consists in laying the top on the cabinet properly positioning it with the help of the self-centering action achieved by the matching of the openings provided in the top with the outlet and air intake; in this way, all the necessary connections for the drying air circulation circuit are completed, and there is no necessity to perform any additional connection.

The Applicant believes that while the top disclosed in EP 2270274 is advantageous under several respects, has some drawbacks.

In particular, a disadvantage of the top disclosed in EP 2270274 consists in that possible leakage of drying air (process air) may occur after the top has been assembled to the machine cabinet. In fact, the positioning of the top is the only occasion for coupling the drying air circuit portion located within the top with the remaining drying air circuit portion placed under the top, i.e. in a lower volume of the machine cabinet. Once the top is assembled to the cabinet, the drying conduit cannot be reached anymore. Since a leakage of process air reduces the performance of a drying process, it would be desirable to improve the fixation of the drying air circuit portions and its verification by an assembler, to avoid any risk of drying air leakage during a drying process.

SUMMARY OF SELECTED INVENTIVE ASPECTS

One aspect of the present invention proposes a laundry machine adapted to dry laundry by means of a flow of drying air. The laundry machine comprises a cabinet for accommodating components necessary for the operation of the laundry machine. Inside the cabinet, a laundry treating chamber adapted to contain the laundry to be dried. A cabinet top element is provided incorporating at least part of a drying air circuit in fluid communication with the laundry treating chamber through a drying air inlet opening and through a drying air outlet opening formed in the cabinet top element. The cabinet top element comprises a bottom base element and a top cover. A drying air path for the flow of drying air between said drying air inlet opening and said drying air outlet opening is defined in an interspace between the base element and the top cover, and said drying air path includes a moisture condensing arrangement for demoisturizing the drying air. The drying air inlet opening is formed in a wall extending within the interspace between the base element of the top element and the top cover thereof.

For example, the base element advantageously comprises an aperture adjacent to the drying air inlet opening. The machine may comprise a return drying air hose coupled at one end thereof to the drying air inlet opening and, at another end, to a drying air outlet of the laundry treatment chamber. The drying air inlet opening is preferably surrounded by a projecting collar arranged in said interspace between the base element and the top cover and the return drying air hose is coupled to the collar. Said wall preferably extends substantially perpendicularly to the base element and the top cover. Advantageously, said wall is formed integrally with the top base element. The end of the return drying air hose that is coupled to the drying air inlet opening may be secured to the projecting collar by means of a hose clamp. Also the end of the return drying air hose that is coupled to the drying air outlet of the laundry treatment chamber may be secured thereto by means of a hose clamp.

Advantageously, the return drying air hose may be provided, proximate to the end thereof that is coupled to the drying air inlet opening, with an annular seat for accommodating the first hose clamp. Similarly, the return drying air hose may be provided, proximate to the end thereof that is coupled to the drying air outlet of the laundry treatment chamber, with an annular seat for accommodating the hose clamp.

Advantageously, the moisture condensing arrangement comprises heat-exchanging units part of a heat pump arranged for exchange of heat between the drying air and a heat pump refrigerant fluid, the heat pump further comprising a refrigerant fluid compressor expediently installed inside the laundry machine cabinet at a bottom part of the laundry machine, particularly attached to a laundry machine basement.

Preferably, the refrigerant fluid compressor is in fluid communication with said heat-exchanging units in the top through flexible refrigerant fluid conduits running along a vertical corner of the machine cabinet.

A refrigerant fluid compressor cooling fan is preferably provided, arranged inside the machine cabinet at the bottom of the laundry machine, preferably attached to the laundry machine basement.

In accordance with aspects of the present invention, it is easier for the machine assembler to ensure that the portion of the drying air circuit outside the cabinet top is connected in an air-tight manner to the portion of the drying air circuit formed within the top.

BRIEF DESCRIPTION OF THE DRAWINGS

These, and others, features and advantages of the solution according to the present invention will be better understood with reference to the following detailed description of some embodiments thereof, provided for illustrative and not restrictive purposes, to be read in conjunction with the attached drawings. In this regard, it is expressly intended that the drawings are not necessarily to scale and that, unless specified otherwise, they simply aim to conceptually illustrate the structures and procedures. In particular.

DETAILED DESCRIPTION OF EXAMPLE EMBODIMENTS

Figure 1:
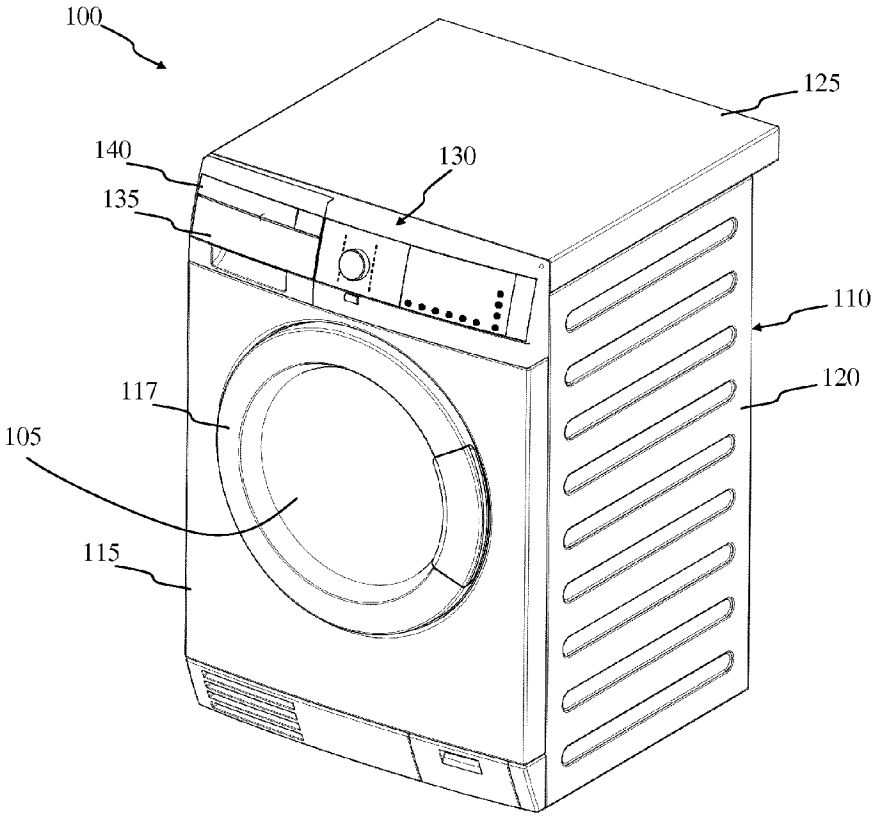
FIG. 1 is a perspective view of a laundry machine according to an embodiment of the present invention.

With reference to the drawings, FIG. 1 is a perspective view of a laundry machine, globally denoted as 100, according to an embodiment of the present invention.

Figure 4:
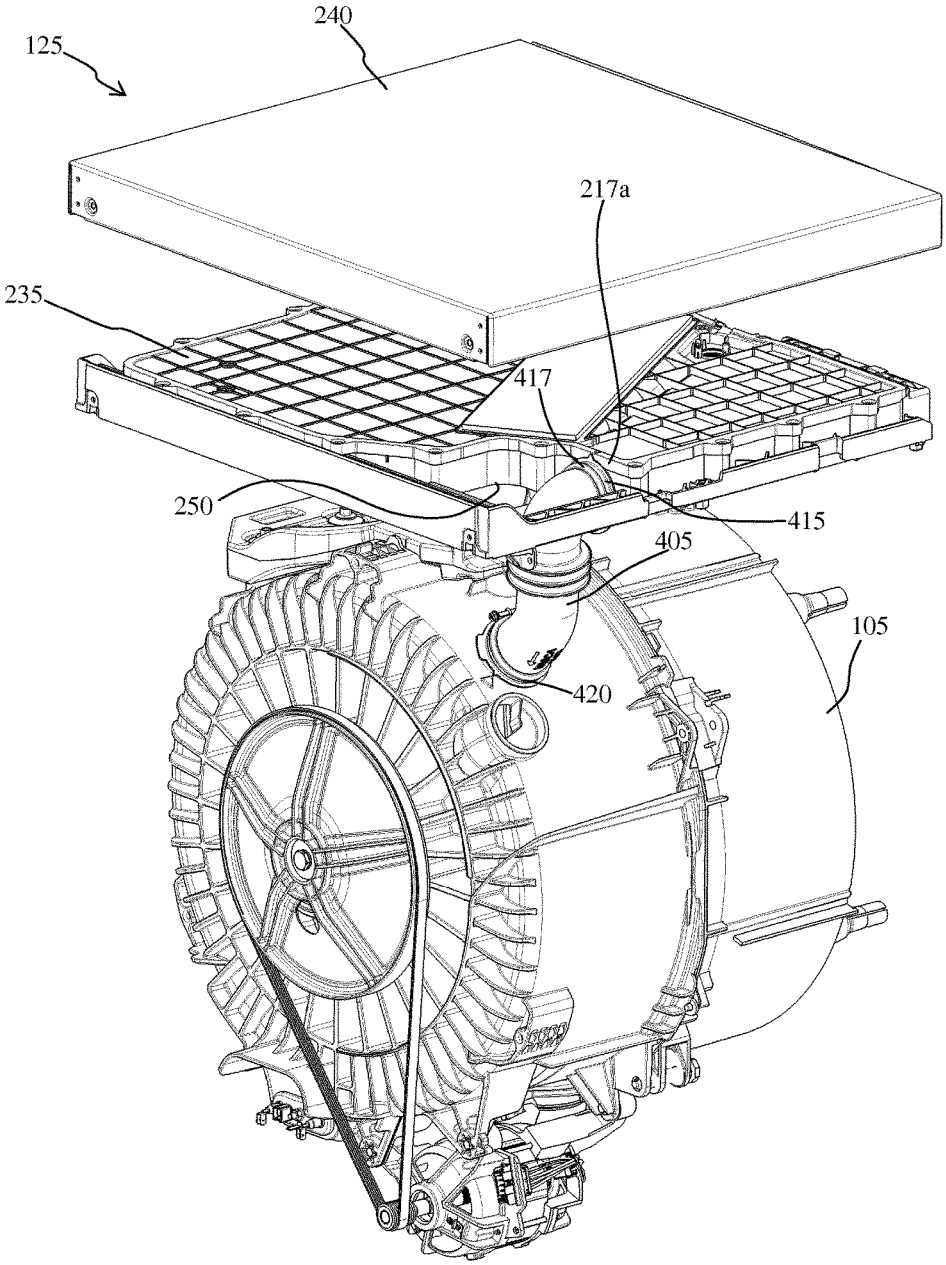
FIG. 4 shows, in perspective exploded view, the cabinet top with a drying air return hose coupled to top and to a drying air outlet of a laundry treatment chamber of the laundry machine.

The laundry machine 100 comprises a laundry treatment chamber 105 for accommodating the items to be dried or washed and dried, such as clothes, garments, linen, and similar laundry items. Preferably, the laundry treatment chamber 105 includes a drum (not shown in the figures) rotatably mounted inside a machine casing or cabinet 110, and in case the laundry machine 100 is a washing/drying laundry machine the drum is arranged within a tub (the tub is not shown in FIG. 1; it is shown in FIG. 4) housed in the machine casing or cabinet 110.

The cabinet 110 generally accommodates all the electrical, electronic, mechanical, and hydraulic components necessary for the operation of the laundry machine. The cabinet 110 has generically a parallelepiped shape, with a front wall 115, two side walls 120 (only one visible in FIG. 1), a rear wall (not visible), a basement and a top 125. The front wall 115 of the cabinet 110 is provided with an access opening for accessing the drum and with an associated door 117, hinged to the front wall 115, for closing the access opening. In the upper part of the front wall 115, a machine control panel 130 is located, and, aside the control panel 130, a drawer 135 is provided, which is part of a washing treatment products dispensing arrangement, for loading laundry washing treatment products like detergents and softeners. The top 125 closes the cabinet 110 from above, and defines a worktop.

In one embodiment of the invention, a de-fluff filter (aesthetic) cover 140 is exposed on the control panel 130 on the front wall 115, e.g. above the drawer 135, and flush therewith.

Figure 2:
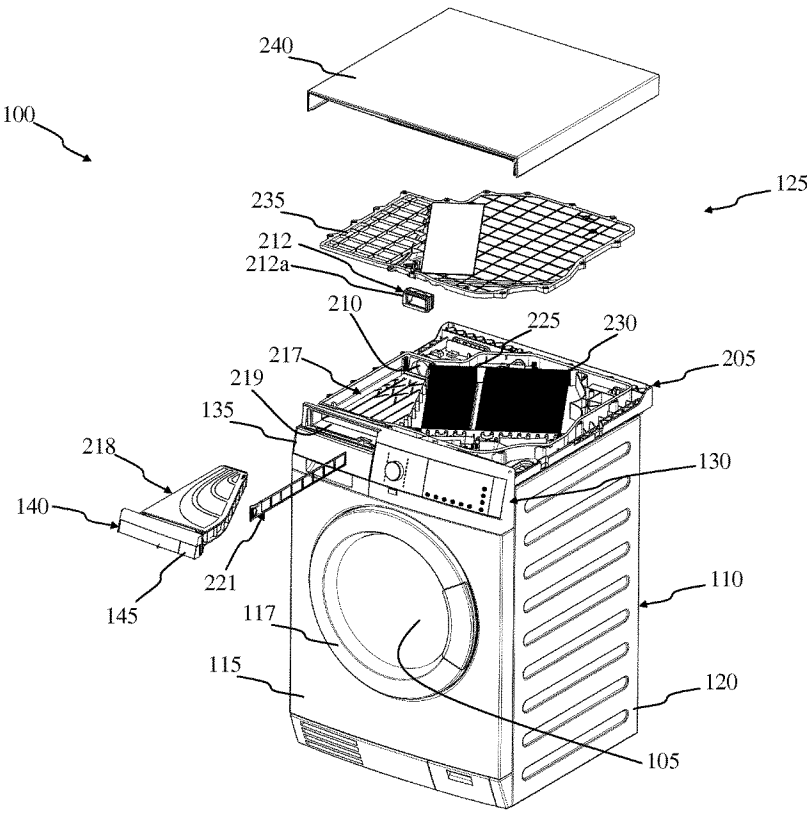
FIG. 2 is a perspective view of the laundry machine of FIG. 1, showing a cabinet top thereof in exploded view.
Figure 3:
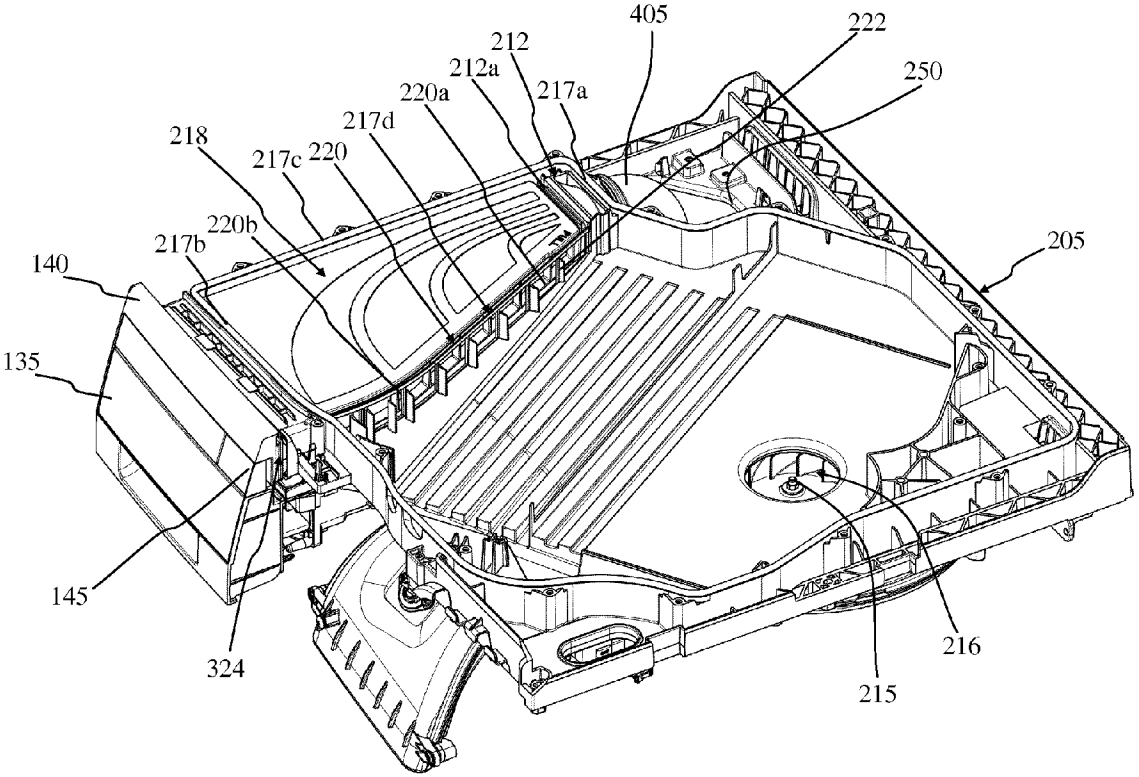
FIG. 3 is a perspective view of a base element of the top of the laundry machine according to an embodiment of the present invention.

Reference is now made to FIGS. 2 and 3, which are, respectively, a perspective view of the laundry machine 100 with its top 125 in exploded view and a perspective view of a base element 205 of the top 125 with some parts removed.

In one embodiment of the invention, the top 125 is formed as a ready-to-mount part ready to be mounted to the cabinet. The top 125 integrates part of a drying air circuit adapted to circulate drying air across the laundry treating chamber 105 for drying the laundry stored therein. In particular, the top 105 forms a moisture condensing module for dehydrating drying air used to dry laundry within a drying drum of the laundry drying appliance. As described hereinafter, the top has a drying air inlet, a drying air outlet, and fluid passageways defined thereinside from said drying air inlet to said drying air outlet for the passage of the drying air to be dehydrated. Moisture condensing means are arranged inside said fluid passageways.

In greater detail, according to an embodiment of the present invention, the top 125 comprises the base element 205, e.g. made of plastic, which has a drying air inlet opening 210 and a drying air outlet opening 215. The drying air inlet opening 210 is in fluid communication (as described in greater detail afterwards) with the laundry treatment chamber 105 through a chamber drying air outlet. The drying air outlet opening 215 is in fluid communication with a blowing arrangement 216.

The blowing arrangement 216 comprises a fan and a corresponding fan duct. The fan blows the drying air inside the air circuit by sucking drying air from the air outlet opening 215 and blowing the drying air into the laundry treatment chamber 105, the air outlet opening 215 and the laundry treatment chamber 105 being both fluidly connected to the blowing arrangement 216.

In a region of the base element 205, preferably near the front-left corner thereof, a de-fluff filter housing 217 is provided suitable to house a de-fluff filter 218. The filter housing 217 has for example (but not limitatively) roughly a right trapezoid outline in plan view (e.g., similar to a grand piano), with a shorter sidewall 217*a* (corresponding to a lesser base of the right trapezoid) in which the drying air inlet opening 210 is formed, and a larger sidewall 217*b* (opposite to the shorter sidewall 217*a*, and corresponding to a greater base of the right trapezoid) that has a housing aperture 219 opened on the machine front wall 115 for example above the drawer 135 for allowing the insertion of the de-fluff filter 218. The filter housing 217 further comprises a right sidewall 217*c* substantially corresponding to a portion of a lateral sidewall of the base element 205 of the top 125 (and corresponding to the right leg of the right trapezoid) and a transversal opened side 217*d*, preferably inclined (opposite to the right sidewall 217*c* and corresponding to the inclined leg of the right trapezoid). The sidewalls of the filter housing 217, particularly the shorter sidewall 217*a*, projects substantially orthogonally from a base plane of the top base element 205. In alternative embodiments the sidewall 217*a*, may form an angle $\alpha$ with a base plane of the top base element 205 such that $0° < \alpha \leq 90°$.

In one embodiment of the present invention, the drying air inlet opening 210 is fluidly connected to an adapter element 212, which is provided to fluidly connect the drying air inlet opening 210 with the filter housing 217 and the de-fluff filter 218 (when inserted in the filter housing 217). Preferably, but not limitatively, the adapter element 212 may be a parallelepiped-shape element adapted to be coupled to the base element 205, with conical or cylindrical passage(s) provided therein with two opposite apertures to fluidly connect the drying air inlet opening 210 with the de-fluff filter 218. The adapter element 212 may be made of any suitable material, e.g. a polymeric material, and is coupled to the base element 205 by means of any suitable coupling arrangement, e.g. by tightly fitting a rear portion of the filter housing 217 (adjacent to the shorter sidewall 217*a*).

In a preferred embodiment of the invention, the aperture facing the filter housing 217 of the adapter element 212 is surrounded by a gasket element 212*a* which protrudes towards the inside of the filter housing 217. In alternative embodiments of the present invention in which the adapter element 212 is not provided, an alternative gasket element may be directly provided around the inlet opening 210.

In one embodiment of the present invention, the transversal opened side 217*d* of the filter housing 217 comprises a frame 220 that defines a plurality of side windows 220*a* separated one from the other by separating elements, such as for example mullion elements 220*b*, preferably prism-shaped. Advantageously, a plurality of flap elements 222 may be provided, protruding from the frame 220 opposite to the filter housing 217 in order to direct the drying air flow exiting the transversal opened side 217*d* towards the remaining of the air circuit defined in the top 125.

In an embodiment of the present invention, a heat pump is used for condensing the moisture of, i.e. de-hydrating, the drying air and for heating the drying air after the de-hydration.

In particular, in the central region of the base element 205, there is accommodated a first heat-exchanging unit of the heat pump, forming a moisture condensing element 225, for example comprising a refrigerant fluid evaporator of the heat pump. The moisture condensing element 225 is adjacent to the transversal opened side 217*d* of the filter housing 217, so as to receive the drying air after the latter has passed through the de-fluff filter 218. Next to the moisture condensing element 225, opposite to the filter housing 217, there is provided a second heat-exchanging unit, forming a drying air heating element 230, for example comprising a condenser of the refrigerant fluid of the heat pump. The moisture condensing element 225 has the function of de-hydrating the drying air, by cooling it down. The drying air heating element 230 has instead the function of heating the dehydrated drying air.

Figure 7:
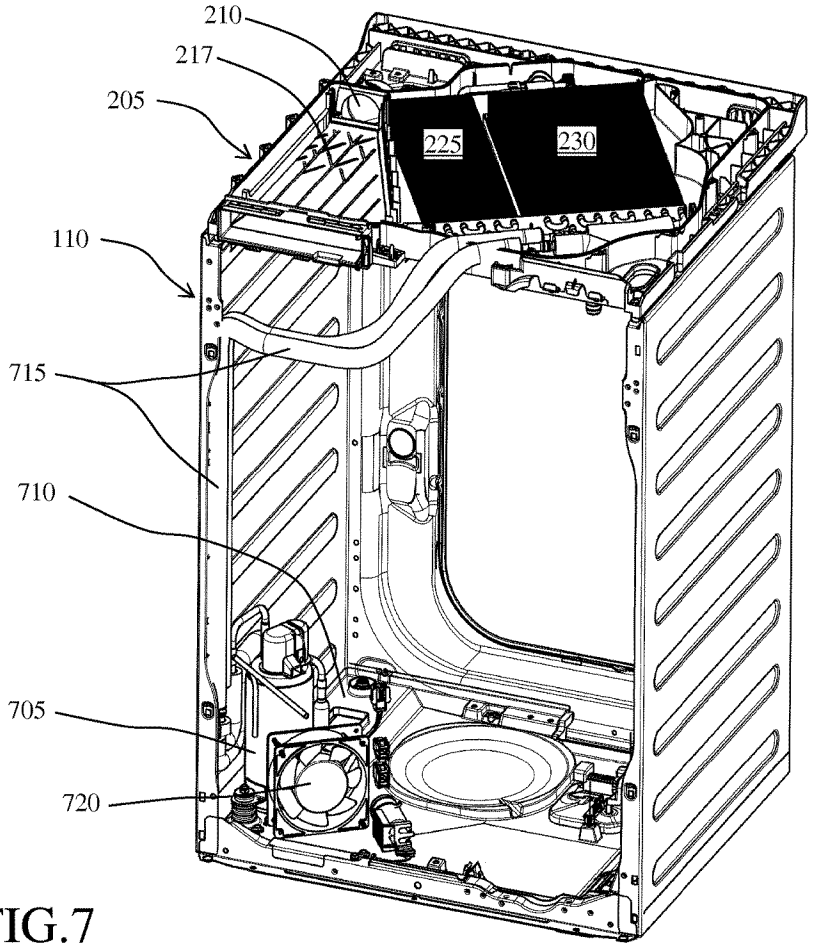
FIG. 7 is a perspective view from the rear of the laundry machine with dismounted cabinet panels.

The first and second heat-exchanging units 225 and 230 are parts of a refrigerant fluid circuit of the heat pump. The refrigerant fluid circuit further comprises a lamination device (e.g. a refrigerant fluid expansion valve) between the first and second heat-exchanging units 225 and 230, and a refrigerant fluid compressor. In an embodiment of the present invention, visible in FIG. 7, the refrigerant fluid compressor 705 is located at the bottom of the cabinet 110, e.g. attached to a basement 710 of the laundry machine 100, and is fluidly connected to the heat-exchanging units 225 and 230 accommodated in the top 125 by means of refrigerant fluid pipes 715 that preferably run along a rear corner of the cabinet 110 or along the laundry treatment chamber 105 of the laundry machine 100. Preferably, the refrigerant fluid pipes 715 are flexible pipes: this facilitates the machine assembling operations, particularly the fluid connection of the compressor 705 mounted to the machine basement 710 to the heat pump heat-exchanging elements 225 and 230 in the cabinet top 125.

In alternative embodiments of the present invention, the refrigerant fluid compressor may be attached to the underside of the base element 205 of the top 125, e.g. in correspondence of the front-right corner thereof, the body of the compressor hanging in such a case from below the base element 205. However, the installation of the compressor 705 at the bottom of the cabinet 110, attached to the machine basement 710, may be preferable because at the bottom of the cabinet 110 there is usually more room than at the top, the machine basement 710 is rigid and resistant, and the compressor cooling is better than at the top of the machine. The existence of more room at the machine bottom also facilitates the provision of a compressor cooling fan 720, for promoting the compressor cooling. Preferably the cooling fan is attached to the machine basement 710.

In different embodiments of the present invention, the laundry machine 100 may comprise an air-air or an air-water heat exchanger apparatus and an electric heater instead of the heat pump. The air-air or air-water heat exchanger apparatus and, possibly, the electric heater are advantageously accommodated inside the top 125.

The base element 205 of the top 125 is covered by an inner panel 235, that covers essentially the first and second heat-exchanging units 225 and 230 and the de-fluff filter 218. The top 125 is completed by an outer (aesthetic) panel 240 that can be secured to the top based element 205 e.g. by screwing. The base element 205 and the inner panel 235 define an air-path that conveys the moisture-laden air coming from the laundry treatment chamber 105 (through the drying air inlet opening 210) towards the de-fluff filter 218, preventing the moisture-laden air from entering directly (i.e., before being filtered by the de-fluff filter 217) the moisture condensing element 225 or the drying air heating element 230, and then the drying air flow follows the air path from the de-fluff filter 218 to the heating element 230, passing through the moisture condensing element 225, eventually reaching the drying air outlet opening 215, where the de-hydrated and heat drying air is sucked by the fan and blown into the laundry treatment chamber 105.

As mentioned in the foregoing, the top 125, once assembled, forms a unit that is ready to be mounted to the cabinet 110, simply by placing it in the correct alignment, particularly with the drying air outlet opening 215 matching the intake of the blowing arrangement 216 The top 125 may be secured to the cabinet 110 by conventional means (e.g., by means of gluing, screwing or other connecting means).

Figure 5A:
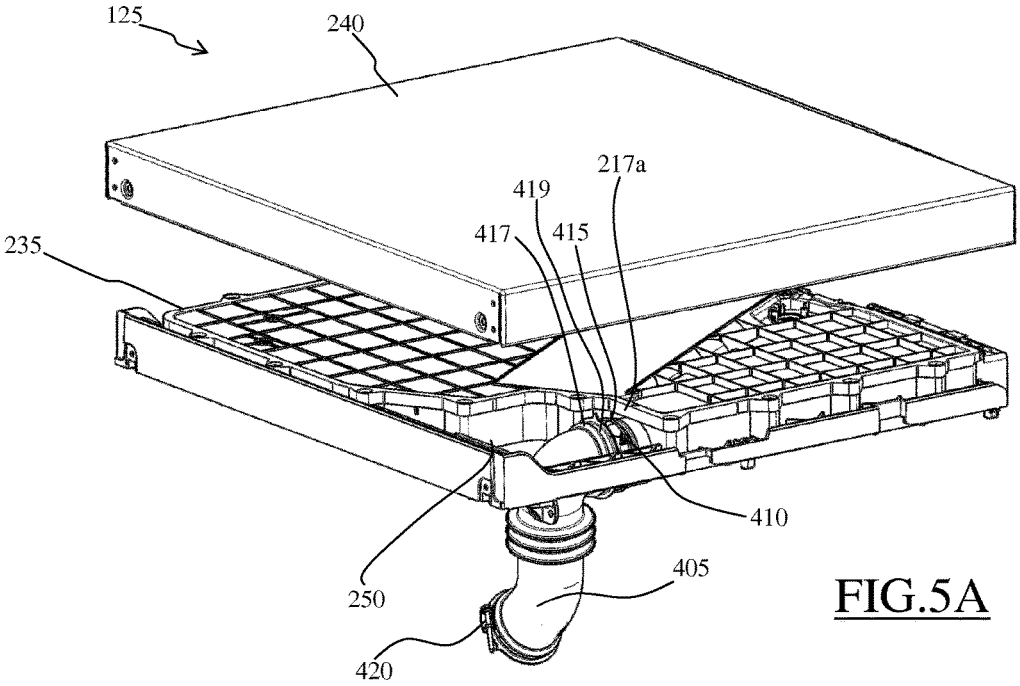
FIG. 5A shows in perspective view the cabinet top with the drying air return hose uncoupled from the top.
Figure 5B:
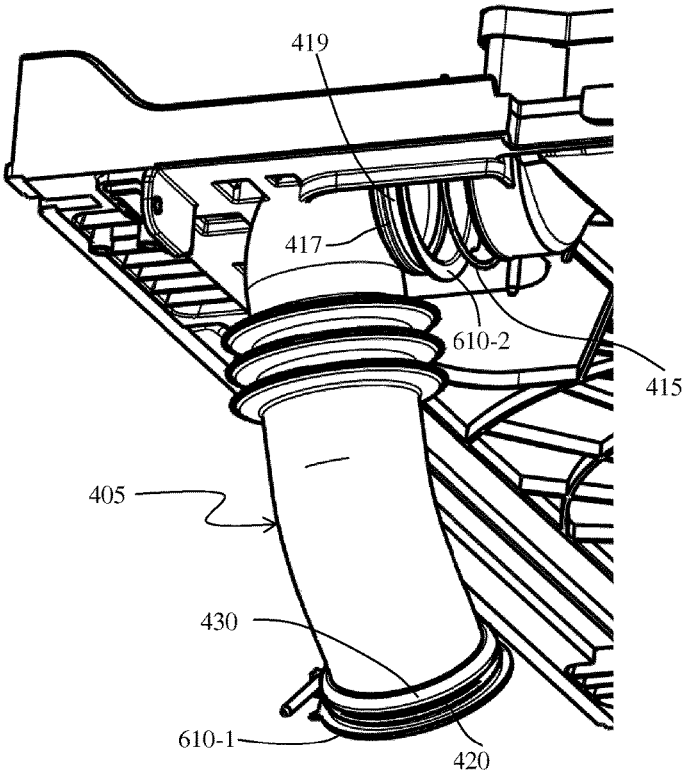
FIG. 5B is a perspective view from below of a detail of FIG. 5A.
Figure 6:
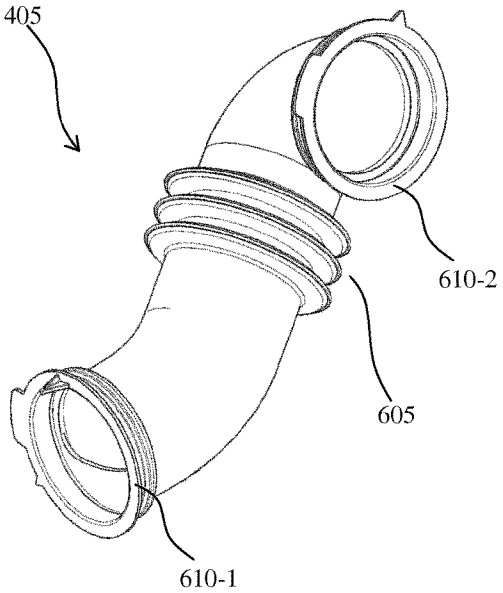
FIG. 6 shows the drying air return hose.

According to aspects of the present invention, for the fluid connection of the drying air inlet opening 210 provided in the top 125 to the drying air outlet of the laundry treatment chamber 105, a drying air return hose 405 is used. The hose 405 is shown per-se in FIG. 6, while in FIGS. 4 and 5A, 5B there is shown the coupling of the hose 405 to the drying air inlet opening 210 of the top 125 (and to a drying air outlet of the laundry treatment chamber 105, e.g. of the tub of a laundry washer/dryer).

The hose 405 is elbow-shaped, having a roughly "S" shape and is preferably flexible and collapsible/extendible to a certain extent. To this purpose, the hose 405 is, at least partly, corrugated: for example, in the example shown in FIG. 6 the hose 405 has a corrugated portion 605.

Preferably, the drying air inlet opening 210 is surrounded by a projecting collar 410, projecting from the sidewall 217*a* of the de-fluff filter housing 217 opposite to the filter housing 217, i.e. the collar 410 projects towards the rear of the top 125. For example, the sidewall 217*a* is generally perpendicular to a base plane of the top base element 205, and the collar 410 extends substantially orthogonally to the sidewall 217*a*, so that the collar 410 has an axis that is substantially parallel to the base plane of the top base element 205 and both the sidewall 217*a* and the collar 410 extend in an interspace between the top base element 205 and the top outer panel 240. For allowing the coupling of the hose 405 to the collar 410 surrounding the drying air inlet opening 210, an aperture 250 is formed in the top base element 205, in the shown example in the region thereof near the rear left corner of the top base element 205.

The hose 405 has two open extremities, 610-1 and 610-2, respectively for the coupling to drying air outlet of the laundry treatment chamber 105 and for coupling to the drying air inlet opening 210 formed in top 125. Preferably, one or both of the hose extremities 610-1, 610-2 are flanged.

The hose extremity 610-2 has an inner diameter slightly greater that the external diameter of the collar 410. The hose extremity 610-2 is slipped on the collar 410, and then, for securing the hose 405 to the collar 410, a hose clamp 415 is used, that is tightened around the portion of the hose 405 near the extremity 610-2 slipped on the collar 410. Preferably, a projecting ring 417 is formed externally on the hose 405 near the extremity 610-2 thereof, so as to define, together with the flange at the extremity 610-2, an annular seat 419 for accommodating and keeping in place the hose clamp 415.

Preferably, the drying air outlet of the laundry treatment chamber 105 is formed in the cylindrical wall of the tub, as shown in FIG. 4.

Similarly to the drying air inlet opening 210 formed in the top 125, a collar is provided around the drying air outlet of the laundry treatment chamber 105. The hose extremity 610-1 has an inner diameter slightly greater that the external diameter of the collar surrounding the drying air outlet of the laundry treatment chamber 105, so the hose extremity 610-1 can be slipped on the collar, and then, for securing the hose 405 to the collar, a hose clamp 420 is used, that is tightened around the portion of the hose 405 near the extremity 610-1 slipped on the collar. Similarly to the hose extremity 610-2, a projecting ring 430 is preferably formed externally on the hose 405 near the extremity 610-1 thereof, so as to define, together with the flange at the extremity 610-1, an annular seat for accommodating and keeping in place the hose clamp 420.

Thus, the portion of the drying air circuit outside the top 125, comprising the drying air return hose 405, accesses the portion of the drying air circuit formed within the top 125 through the aperture 250 formed in the top base element 205. The portion of the drying air circuit outside the top 125, particularly the drying air return hose 405, connects to the portion of the drying air circuit formed within the top 125 via the drying air inlet opening 210 formed in the sidewall 217*a*.

In the laundry machine 100, when operated in dryer mode (i.e., for drying items stored in the drum), drying air (i.e., warm and dry air) is typically caused to flow through the drum 105 inside the laundry treating chamber 105, where the items to be dried are contained. The drying air binds to moisture particles from the laundry and/or dispersed within the laundry treating chamber 105 and carries them away. The drying air may also carry away fluff (e.g., generated from the laundry during laundry treating processes) from the laundry together with moisture particles. After exiting the drum through the chamber outlet, the flow of now moisture-laden drying air passes through the de-fluff filter 218 where substantially any fluff carried by the drying air flow together with moisture particles is caught and remains trapped. Instead, the moisture-laden drying air is conveyed towards the moisture condensing element 225, where the moisture-laden drying air is at least partially dried, i.e. dehydrated, and such dehydrated drying air flow is then heated by the air heating element 230 through which the drying air flows, which heats the drying air up to a drying temperature (e.g., set by a user through the control panel 130 via the selection of a drying program). Then the drying air is sucked by the fan through the fan intake and is caused to pass again through the drum 105 drying the laundry therein stored and then repeating the cycle just described.

The invention claimed is:

1. A laundry machine configured to dry laundry by means of a flow of drying air, comprising:

a machine cabinet for accommodating components necessary for the operation of the laundry machine;

inside the cabinet, a laundry treatment chamber configured to contain the laundry to be dried;

a cabinet top element incorporating at least part of a drying air circuit in fluid communication with the laundry treating chamber through a drying air inlet opening and through a drying air outlet opening formed in the cabinet top element, the cabinet top element comprising a bottom base element and a top cover and, defined in an interspace between the base element and the top cover, a drying air path for the flow of drying air between said drying air inlet opening and said drying air outlet opening, said drying air path including a moisture condensing arrangement, wherein the drying air inlet opening is formed in a wall extending within the interspace between the base element of the top element and the top cover thereof.

2. The laundry machine of claim 1, wherein the base element comprises an aperture adjacent to the drying air inlet opening.

3. The laundry machine of claim 1, comprising a return drying air hose coupled at one end thereof to the drying air inlet opening and, at another end, to a drying air outlet of the laundry treatment chamber.

4. The laundry machine of claim 3, wherein the drying air inlet opening is surrounded by a projecting collar arranged in said interspace between the base element and the top cover and the return drying air hose is coupled to the collar.

5. The laundry machine of claim 1, wherein the wall extends substantially perpendicularly to the base element.

6. The laundry machine of claim 1, wherein the wall is formed integrally with the base element.

7. The laundry machine of claim 4, wherein the end of the return drying air hose coupled to the drying air inlet opening is secured to the projecting collar by means of a first hose clamp.

8. The laundry machine of claim 7, wherein the end of the return drying air hose coupled to the drying air outlet of the laundry treatment chamber is secured thereto by means of a second hose clamp.

9. The laundry machine of claim 8, wherein the return drying air hose is provided, proximate to the end of the return drying air hose coupled to the drying air inlet opening, with an annular seat for accommodating the first hose clamp.

10. The laundry machine of claim 9, wherein the return drying air hose is provided, proximate to the end of the return drying air hose coupled to the drying air outlet of the laundry treatment chamber, with a further annular seat for accommodating the second hose clamp.

11. The laundry machine of claim 1, wherein said moisture condensing arrangement comprises heat-exchanging units part of a heat pump arranged for exchange of heat between the drying air and a heat pump refrigerant fluid, the heat pump further comprising a refrigerant fluid compressor installed inside the laundry machine cabinet at a bottom part of the laundry machine.

12. The laundry machine of claim 11, wherein the refrigerant fluid compressor is in fluid communication with said heat-exchanging units in the top through flexible refrigerant fluid conduits, preferably running along a vertical corner of the machine cabinet.

13. The laundry machine of claim 11, further comprising a refrigerant fluid compressor cooling fan arranged inside the machine cabinet at the bottom of the laundry machine, preferably attached to the laundry machine basement.

14. The laundry machine of claim 7, wherein the return drying air hose is provided, proximate to the end of the return drying air hose coupled to the drying air inlet opening, with an annular seat for accommodating the first hose clamp.

15. The laundry machine of claim 11, wherein the refrigerant fluid compressor is attached to a laundry machine basement.

16. The laundry machine of claim 12, wherein the flexible refrigerant fluid conduits run along a vertical corner of the machine cabinet.

17. The laundry machine of claim 13, wherein the refrigerant fluid compressor cooling fan is attached to the laundry machine basement.

* * * * *